US009074831B2

(12) United States Patent
Glock

(10) Patent No.: US 9,074,831 B2
(45) Date of Patent: Jul. 7, 2015

(54) RECEIVER FOR A FIREARM

(71) Applicant: Value Privatstiftung, Velden (AT)

(72) Inventor: Gaston Glock, Velden (AT)

(73) Assignee: VALUE PRIVASTIFTUNG (AT)

( * ) Notice: Subject to any disclaimer, the term of this patent is extended or adjusted under 35 U.S.C. 154(b) by 0 days.

(21) Appl. No.: 13/987,158

(22) Filed: Jul. 5, 2013

(65) Prior Publication Data

US 2014/0007479 A1 Jan. 9, 2014

(30) Foreign Application Priority Data

Jul. 9, 2012 (AT) ..... A 760/2012

(51) Int. Cl.
*F41C 23/10* (2006.01)
*F41A 3/66* (2006.01)

(52) U.S. Cl.
CPC .. *F41A 3/66* (2013.01); *F41C 23/10* (2013.01)

(58) Field of Classification Search
CPC ..... F41C 23/00; F41C 23/04; F41C 23/10; F41C 23/12
USPC ..... 42/71.01, 71.02, 72, 74; D22/104, 108; 24/584.1, 586.1, 586.11, 591.1, 594.1, 24/DIG. 38
See application file for complete search history.

(56) References Cited

U.S. PATENT DOCUMENTS

| | | | | |
|---|---|---|---|---|
| 3,267,923 | A * | 8/1966 | Ronci | 124/84 |
| 3,618,248 | A * | 11/1971 | Into et al. | 42/71.01 |
| 5,231,237 | A * | 7/1993 | Cupp | 42/71.02 |
| 6,112,446 | A * | 9/2000 | Förster et al. | 42/71.02 |
| 7,587,852 | B1 * | 9/2009 | Harms | 42/71.02 |
| 7,765,999 | B1 * | 8/2010 | Stephens et al. | 124/73 |
| 8,156,677 | B2 * | 4/2012 | Glock | 42/71.02 |
| 2005/0215092 | A1 * | 9/2005 | Schoppman et al. | 439/101 |
| 2009/0288324 | A1 * | 11/2009 | Peterson et al. | 42/75.03 |
| 2010/0132238 | A1 * | 6/2010 | Werner et al. | 42/71.02 |
| 2010/0154279 | A1 * | 6/2010 | Polyzos et al. | 42/117 |
| 2010/0212202 | A1 * | 8/2010 | Roth | 42/71.01 |
| 2012/0222342 | A1 * | 9/2012 | Chvala | 42/74 |

* cited by examiner

*Primary Examiner* — Bret Hayes
(74) *Attorney, Agent, or Firm* — Kolisch Hartwell, P.C.

(57) ABSTRACT

A receiver for a firearm is provided with anchoring structures for mounting an accessory part having complimentary anchoring structures. At least one anchoring structure on the receiver comprises a through hole and a complimentary through hole on the accessory part such that when it is mounted on the receiver the through holes are aligned such that a fastening pin can be inserted. At least one anchoring structure comprises a portion of the lower edge of the receiver that engages a complimentary anchoring structure on the accessory part. At least one anchoring structure comprises a first projection and an adjacent first indentation at the upper, rear portion of the receiver with said first indentation being further away from the through hole than said first projection. A complimentary anchoring structure on the accessory part attaches in the manner of a snap mechanism.

4 Claims, 3 Drawing Sheets

RECEIVER FOR A FIREARM

This application claims priority to Austrian Patent Application No. A 760/2012 AT filed Jul. 9, 2012 which is incorporated by reference in its entirety as if set forth herein.

BACKGROUND OF THE INVENTION

1. Field of the Invention

The invention concerns a firearm and an accessory for a firearm, in particular a gun corresponding to the preamble clause of Claim 1 and to AT 508 316 of the applicant, which corresponds to U.S. Pat. No. 8,156,677, the contents of which are incorporated into the content of this present application by reference in their entirety as if set forth herein.

2. Description of Related Art

Such gun which was already previously known has a receiver which is fully able to function and with which it is possible, in a simple manner and without dismantling the receiver, to attach shell-like accessory parts to it that lie on the exterior of the receiver by means of which it becomes possible for users with hands that are larger or structured differently to carry out a special adaptation of the size and shape of the receiver for their needs.

The measures that are proposed in the referenced documents have proven themselves and have also stood up to rough operation in practice, but there is demand to continue the most essential replacement part that is provided in the rear of the receiver up to the upper edge of the grip, in order to form a smooth and transition-free surface in the area of the hand between the thumb and forefinger during the use of the gun. Because of the special shape of this area and the extremely restricted spatial relationships in the upper area of the rear edge of the receiver immediately behind and below the action, such a formation is not provided with the cited prior art. The prior art accessory part ends lower in the area where it is secured by a pin.

It is the problem of the invention, then, to provide a receiver or an accessory part that also fulfills this need and, in so doing, is nevertheless light and easy to install and possesses the necessary mechanical stability.

SUMMARY OF THE INVENTION

A receiver for a firearm is provided with anchoring structures for mounting an accessory part having complimentary anchoring structures. At least one of said anchoring structures on the receiver comprises a through hole and a complimentary anchoring structure on the accessory part comprises one or more through holes such that when the accessory part is mounted on the receiver the through holes on the receiver and the accessory part are aligned such that a fastening pin can be inserted. At least one of said anchoring structures comprises a portion of the lower edge of the receiver that engages a complimentary anchoring structure on the accessory part such as a flange. At least one of said anchoring structures comprises a first projection and an adjacent first indentation located at the upper, rear portion of the receiver with said first indentation being further away from the through hole than said first projection. A complimentary anchoring structure on the accessory part comprises a second indentation and an adjacent second projection such that when the accessory part is mounted on the receiver the first projection of the receiver functions together with the second indentation of the accessory part and the first indentation of the receiver functions together with the second projection of the accessory part in the manner of a snap mechanism.

DETAILED DESCRIPTION

The following description is presented to enable any person skilled in the art to make and use the invention. For purposes of explanation, specific nomenclature is set forth to provide a thorough understanding of the present invention. Descriptions of specific embodiments or applications are provided only as examples. Various modifications to the embodiments will be readily apparent to those skilled in the art, and general principles defined herein may be applied to other embodiments and applications without departing from the spirit and scope of the invention. Thus, the present invention is not intended to be limited to the embodiments shown, but is to be accorded the widest possible scope consistent with the principles and features disclosed herein.

In various exemplary embodiments on a gun with a slide, located on the rear end surface of the receiver in the edge area immediately below the slide is a combination of an indentation and a projection that are formed symmetrically to the gun's center plane, wherein the indentation, viewed along the outline, is physically closer to the slide than the projection, which is closer to the base of the receiver. However, the distance from the projecting part of the projection to the slide is smaller than from the deepest part of the indentation to the slide. The accessory part has a form that is complementary to this, and thus the accessory part is reliably held in its uppermost edge area by means of this clickable connection.

The functioning of this structure is possible by means of the fact that first of all, the lowest part of the accessory part, which as is known from the prior art including U.S. Pat. No. 8,156,677, is formed in a collar-like manner with a flange that is first fitted into the corresponding recesses on the lower edge of the receiver. This provides an anchor point for the clickable connection that was described above in the uppermost area. Finally, the pin that runs obliquely to the axis of symmetry of the gun fixes the position and shape of the accessory part and thus also retains the attachment in the upper part. For detaching, it is only necessary to remove the retaining pin and thereupon, by means of the elastic deformation of the accessory part, to detach this from the upper positive-locking connection, whereupon by means of moving the accessory part downward, away from the slide, the securing in the area of the collar is also detached.

Figure 4:
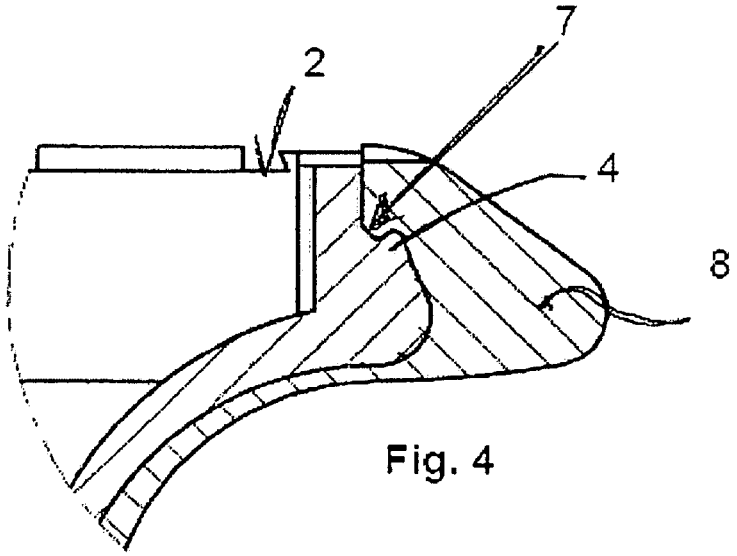
FIG. 4 shows an enlarged view of the area of detail IV from FIG. 2.

Referring to the Figures, exemplary embodiments of a gun 1 are shown which in its rearmost area and slightly below a suitably selected plane 2 which preferably forms the border plane between the receiver 3 and the slide (not depicted), is provided with a projection 4. The plane 2 serves as a reference plane for the explanation of the inventive features and characteristics, not as a technical feature in and of itself. This plane 2 is to be assumed to be as "high" as possible relative to the receiver in order to be practical for the explanation of the invention. If the contour of the gun 1 is followed from the area of the lower edge 6 of the receiver 5 in the direction toward the plane 2 (which in FIG. 4 is indicated as "2" parallel to this and somewhat higher than in the other figures), then an indentation 7 follows the projection 4.

Figure 1:
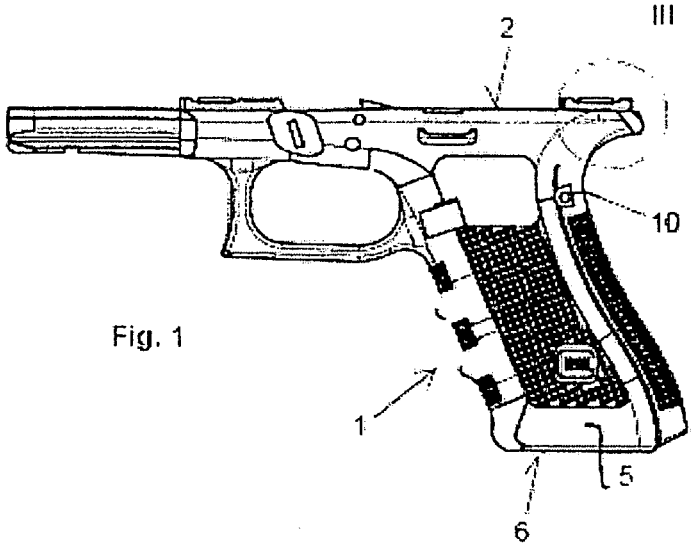
FIG. 1 shows a side view of an exemplary embodiment of a gun as described herein.
Figure 2:
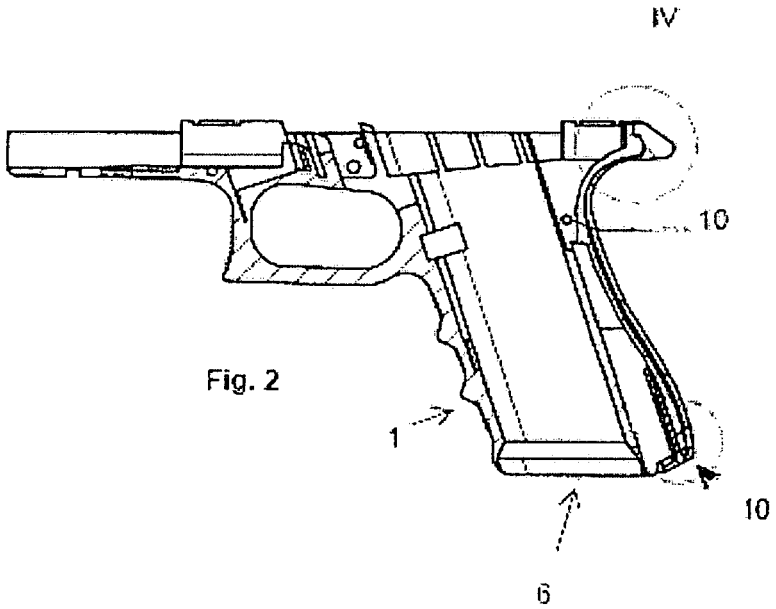
FIG. 2 shows a cross-sectional view of the gun of FIG. 1 along the gun's center plane of symmetry, and an accessory part.
Figure 3:
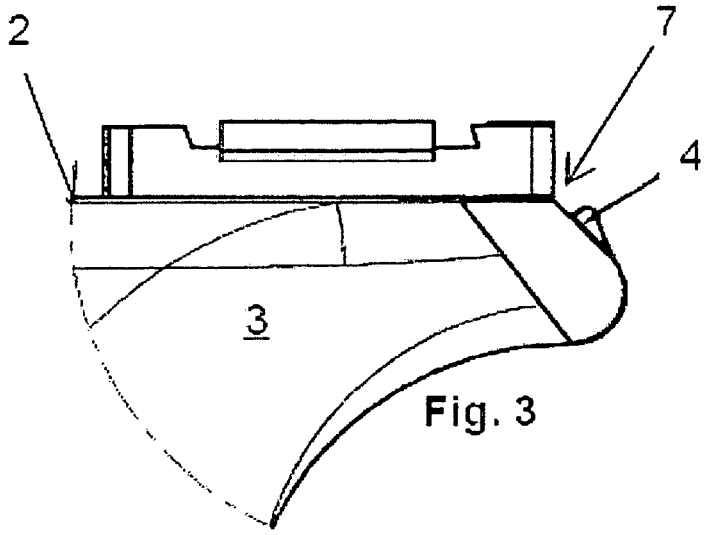
FIG. 3 shows an enlarged view of the area of detail III from FIG. 1.
Figure 6:
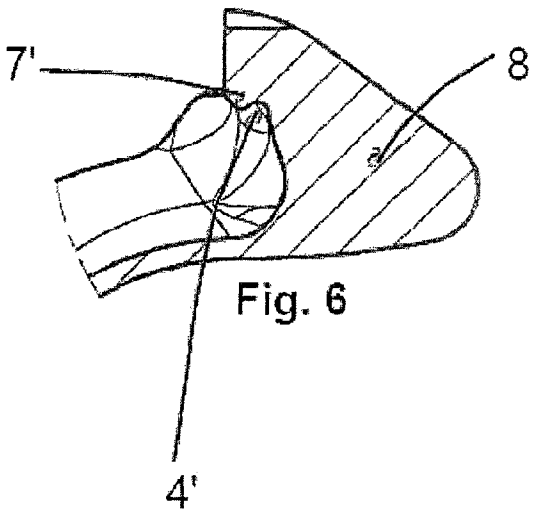
FIG. 6 shows an enlarged view of the area of detail VI from FIG. 5.

Both the projection 4 and the indentation 7 preferably lie in the plane of symmetry of the gun 1. If two of each such elements are provided, then they preferably lie symmetrical to this plane of symmetry, which in the section views shown in FIGS. 2, 4, and 6 corresponds to the plane of the drawing.

Figure 5:
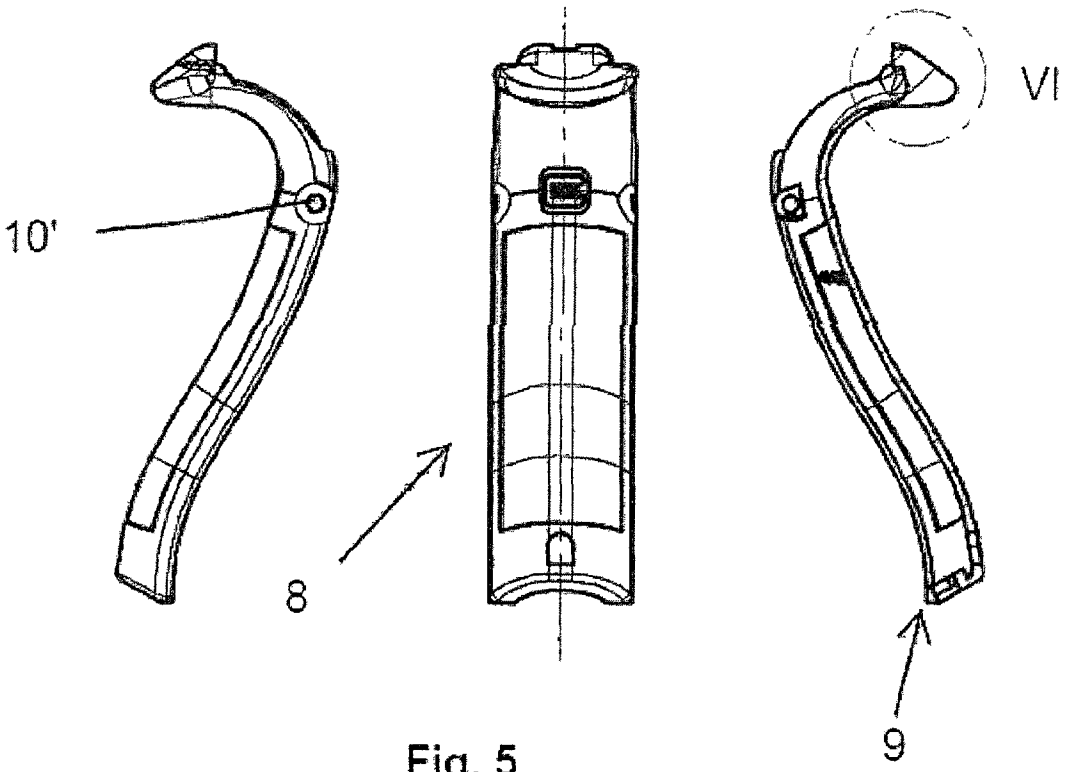
FIG. 5 shows three views of an exemplary embodiment of an accessory part described below.

If the largest distance between the lowest area of the indentation 7 and the plane 2 is compared with the smallest distance between the highest point of projection 4 and the plane 2, then it must be determined that the largest distance of the indentation is larger than the smallest distance of the projection. This relationship has great importance for the mechanical connection of the receiver 5 with the accessory part 8. The accessory part 8 that attaches to the gun 1 is depicted in greater detail in FIGS. 5 and 6. FIG. 5 depicts a lateral view, a rear view, and, in the right area of the representation, a section along the line V-V of the central view. From this section and in particular from FIG. 6, which depicts the detail VI of FIG. 5 at an enlarged scale, the complementary form of the contour of the accessory part 8, which is directed toward the receiver 5, clearly emerges, providing a projection 7' fitting with the indentation 7, and a recess 4' fitting with the projection 4.

The attachment or removal of the accessory part 8 then takes place as follows. If an accessory part 8 is to be mounted on the receiver 5, then this accessory part is first pushed, with its lower edge area 9 which is known from prior art and which is turned upside down, into a matching slot or undercut on the lower end of the receiver 5 in the area of the lower edge 6 of the receiver 5, as is indicated by the arrow 10 in FIG. 2. By means of elastic deformation, the uppermost area of the accessory part 8 with its projection 7' complementary to the indentation 7, and its recess 4' complementary to the projection 4, is thereupon connected with these two elements by means of snapping, whereupon a through hole 10' of the accessory part, as is known from prior art, is aligned with a through hole 10 in the of the grip area of the receiver and is connected in this position by means of a pin (not illustrated).

In this mounted configuration, the distance between the through hole 10' and the projection 7' or the indentation 4' of the accessory part is too small to be able to be disengaged from the projection 4 or the indentation 7 of the gun 1 by means of elastic deformation; the connection is mechanically stable in a positive-locking manner, while it is non-positive without the connecting pin and thus is nondestructively detachable.

The invention is not restricted to the depicted embodiment, but rather it can be repeatedly modified and adapted to other guns. It therefore goes without saying that it is also possible to use it with revolvers, with rifles, with carbines, etc. Within such contexts, it is necessary, rather than with the plane 2 that is provided with pistols, to select a different plane that can be any plane normal to the plane of symmetry of the gun parallel to the barrel axis, although it should lie "on the other side" of the projection 4 or the indentation 7 to keep the explanation simple.

With regard to materials, all materials are possible that are used for guns of this type for receivers or receiver parts; high-quality plastics in particular present themselves here. It goes without saying that these can be reinforced with different elements (fibers, pellets, etc.) or can be built from several layers and in particular can be provided with various platings or coatings on their outer surface that faces the user in order to make possible a secure hold and a pleasant grip.

To sum it up, the following can be established: the invention concerns a firearm with a receiver 5. Anchoring areas are provided on the receiver 5 for the optional mounting of an accessory part 8, which is provided with the matching anchoring areas. One anchoring area of the receiver 5 has a through hole 10, the associated anchoring area of the accessory part 8 has through holes 10' which in the mounted state of the accessory part are aligned and are fastened by means of a pin. Another anchoring area consists of the lower edge 6 of the receiver 5, and the associated anchoring area of the accessory part 8 consists of a collar 9 or flange that engages in the area of the lower edge 6. In order for the accessory part to be able to reach high up the receiver, it has at the rearmost, uppermost area a projection 4 and adjacent to it, an indentation 7 which functionally work together with a indentation 4' or a projection 7' in the manner of a snap mechanism.

What is claimed is:

1. A firearm comprising a receiver and a slide disposed on the receiver, the receiver having an upper portion proximal to the slide, a lower portion distal from the slide, and a rear portion distal from a muzzle of the firearm, wherein the receiver further comprises:

plural receiver anchoring structures for mounting an accessory part having complementary accessory anchoring structures wherein:

at least one of said receiver anchoring structures comprises at least one through-hole and wherein a complementary anchoring structure on such an accessory part comprises at least one through-hole such that when such an accessory part is mounted on the receiver the through-holes on the receiver and such an accessory part are aligned such that a fastening pin can be inserted;

at least one of said receiver anchoring structures comprises a portion of a lower rear edge of the receiver and wherein a complementary anchoring structure on such an accessory part comprises a flange such that when such an accessory part is mounted on the receiver the flange engages the lower edge of the receiver;

at least one of said receiver anchoring structures comprises a first projection and an adjacent first indentation located at an upper, rear portion of the receiver with said first indentation being further away from the through-hole than said first projection, said first indentation projecting substantially upwardly from the receiver, and wherein a complementary anchoring structure on such an accessory part comprises a second indentation and an adjacent second projection such that when such an accessory part is mounted on the receiver the first projection of the receiver functions together with the second indentation of such an accessory part and the first indentation of the receiver functions together with the second projection of such an accessory part as a positive-locking connection mechanism.

2. The firearm according to claim 1, wherein the projection and the indentation on the receiver are arranged symmetrically with respect to a center plane of the firearm.

3. The firearm according to claim 1, wherein the plural receiver anchoring structures are configured for mounting an accessory part that is a backstrap accessory part.

4. The firearm according to claim 1, wherein the first projection is located at a rearmost and uppermost portion of the receiver.

* * * * *